US011440721B1

(12) United States Patent
Kopman

(10) Patent No.: US 11,440,721 B1
(45) **Date of Patent: *Sep. 13, 2022**

(54) AIRLOCK APPARATUS AND METHOD

(71) Applicant: Vladislav Kopman, New York, NY (US)

(72) Inventor: Vladislav Kopman, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/000,343

(22) Filed: Aug. 23, 2020

Related U.S. Application Data

(63) Continuation of application No. 15/911,060, filed on Mar. 2, 2018, now Pat. No. 10,793,339.

(51) Int. Cl.
*B65D 25/08* (2006.01)
*B65D 25/10* (2006.01)
*B65D 81/20* (2006.01)

(52) U.S. Cl.
CPC ..... *B65D 81/2015* (2013.01); *B65D 25/08* (2013.01); *B65D 25/10* (2013.01)

(58) Field of Classification Search
CPC ..... B65D 25/08; B65D 25/10; B65D 25/106; B65D 25/107; B65D 81/2007; B65D 81/2015; B65D 81/2069; B65F 1/06; B65F 1/065; B65F 1/16; B65F 1/1601; B65F 2001/1653; B65F 2001/1676; B65F 2210/1675; B65F 2240/145
USPC ..... 220/262–264, 495.01, 501, 502; 53/567, 53/576
See application file for complete search history.

(56) References Cited

U.S. PATENT DOCUMENTS 1,265,148 A * 5/1918 Warren ..... A24F 19/06 220/345.5
5,440,978 A * 8/1995 O'Brien ..... B65F 1/141 220/264
5,651,231 A 7/1997 Garland
5,765,339 A 6/1998 Garland
6,128,890 A * 10/2000 Firth ..... B65F 1/062 83/649
6,941,733 B2 * 9/2005 Chomik ..... B65F 1/12 53/567
8,033,414 B2 11/2011 Conforti
8,127,960 B2 * 3/2012 Li ..... B65F 1/10 220/259.2
8,245,864 B2 8/2012 Garland
8,333,293 B2 9/2012 Morand
8,662,337 B2 * 3/2014 Lacy ..... B65F 1/1405 220/264
8,752,723 B2 6/2014 Lucas et al.
8,833,592 B2 9/2014 Dunn et al.
9,440,788 B2 9/2016 Gkinosatis
9,493,302 B2 11/2016 Rousso et al.
(Continued)

*Primary Examiner* — Joshua E Rodden

(57) ABSTRACT

An apparatus for transporting objects from a first compartment to a second compartment, where a movable valve element gates off the first compartment from the second compartment. The device includes a transfer element operable with the valve element to prevent the valve element from opening when the transfer element is not engaging the first compartment and to prevent articles and particulates, fluids, gases, odors, and matter from the second compartment from entering the first compartment when the valve element is open. A method for transferring articles into a container is also provided.

21 Claims, 18 Drawing Sheets

(56) References Cited

U.S. PATENT DOCUMENTS

| | | | | |
|---|---|---|---|---|
| 9,573,757 | B1 * | 2/2017 | Stravitz | B65F 1/06 |
| 9,598,207 | B2 * | 3/2017 | Morand | B65D 25/16 |
| 9,745,127 | B1 * | 8/2017 | Stravitz | B65F 1/06 |
| 9,994,393 | B2 * | 6/2018 | Dunn | B65F 1/163 |
| 10,377,564 | B2 * | 8/2019 | Campbell | B65F 1/1405 |
| 2002/0038535 | A1 * | 4/2002 | Jensen | B65B 9/15 53/567 |
| 2005/0044819 | A1 * | 3/2005 | Chomik | B65B 9/15 53/469 |
| 2005/0274093 | A1 * | 12/2005 | Stravitz | B65B 67/1277 53/567 |
| 2006/0179795 | A1 | 8/2006 | Barker | |
| 2008/0184677 | A1 * | 8/2008 | Morand | B65F 1/062 53/574 |
| 2009/0120820 | A1 * | 5/2009 | Iske | A61B 50/362 414/808 |
| 2009/0184125 | A1 * | 7/2009 | Brown | B65F 1/163 220/255 |
| 2010/0301050 | A1 * | 12/2010 | Garland | B65F 1/06 220/495.08 |
| 2014/0000226 | A1 | 1/2014 | Staab et al. | |
| 2014/0054293 | A1 * | 2/2014 | Goodfield | A61F 13/84 220/521 |
| 2015/0021334 | A1 | 1/2015 | Morand | |
| 2015/0068155 | A1 * | 3/2015 | Chomik | B65B 7/12 53/390 |
| 2018/0057257 | A1 * | 3/2018 | Campbell | B65F 1/12 |
| 2018/0194554 | A1 * | 7/2018 | Cole | B65F 1/068 |
| 2019/0291949 | A1 * | 9/2019 | Ross | B65F 1/065 |

* cited by examiner

AIRLOCK APPARATUS AND METHOD

CROSS-REFERENCE TO RELATED APPLICATIONS

This application is a continuation of and claims priority to U.S. patent application Ser. No. 15/911,060, filed Mar. 2, 2018, which claims priority to U.S. Provisional Application Ser. No. 62/466,681, filed Mar. 3, 2017, the disclosures of which are hereby fully incorporated by reference in their entireties as if fully set forth herein.

BACKGROUND

Field of the Disclosure

The present invention relates generally to airlock, valving, and container systems for transporting objects from one region to another region. More specifically, the invention relates to a device that enables the movement of articles, objects, or matter from a first compartment to a second compartment while regulating the transfer of matter from the first compartment to the second compartment and preventing the release of matter from the second compartment to the first compartment.

Related Art

Devices and systems for the passage of matter between two regions separated by a barrier/valve, that may be toggled between an open state and a closed state, have been known for some time. One example of such devices are doors (e.g. hinged, sliding, and revolving), providing passage for people and objects to/from buildings, rooms, vehicles, etc. Another example are airlock systems, also providing passage for people and objects, in the form of a valving or room between two regions. Yet another example of such devices are containers, typically used for the storage/preservation of objects such as foods/beverages, chemicals, compounds, raw materials, etc., and the disposal of objects such as food scraps, diapers (nappies), and medical, biohazardous, chemical waste, etc.

The simplest example of said containers typically consists of a compartment with an opening and a removable/openable cover, such as a lid, door, or flap, which closes off the opening, and thereby the compartment. Objects are usually placed into such containers by opening the cover and then depositing the object into the compartment and re-closing the cover. The problem with such containers is that the compartment and its content are exposed to the outside environment once the cover is opened. In storage/preservation applications, this results in allowing unregulated amounts of oxygen-rich air or other undesired substances to enter the container, potentially shortening the storage life of the content and additionally leaves the opening exposed when the cover is open such that the content may easily spill/fall out of the container. In disposal applications, opening the cover allows the unregulated release of particulates, fluids, gasses, odors, etc. out of the container, which may provide unpleasant, unsanitary, and in some cases dangerous conditions.

Containers with more elaborate barrier/valve configurations, employed to mitigate the challenges of said lidded containers have also been well known for some time. In some examples, devices have rotating drums with an opening for transferring objects to the container. Such containers are often subject to the objects getting stuck during transfer and to the leakage of particulates and odors from the container. In other examples, devices rely on flexible liners, films, or tubes and a closing element acting on said liners, films, or tubes to contain the transferred objects. Such devices often rely on cartridges or cassettes for providing the liners, which is a cost in addition to that of the device incurring for the duration of use of the device. Further, such devices are also subject to the leakage of particulates and odors from the container and tube.

Accordingly, it would be desirable to provide an apparatus that avoids these and other problems.

SUMMARY

It is an object of the present invention to provide an apparatus with a valve element that gates off passage between two compartments and the valve element movable between an open position in which the two compartments are in communication with one another and a closed position in which the two compartments are not in communication with one another, where an article, object, or matter may be transported between the compartments by virtue of a transfer element, actuator, or force due to pressure, magnetism, or gravity, where the valve element operates in accord with the transfer element through an energy transmission means, which may consist of a combination of gears, wheels, racks, springs, linkages, cables, or actuators or any other suitable elements.

An apparatus in accordance with an embodiment of the present application includes a movable valve element disposed between a first compartment and a second compartment with the valve element movable between an open position in which the first compartment is in communication with the second compartment and a closed position in which the first compartment is not in communication with the second compartment. A transfer element allows for the advancement of objects from the first compartment to the second compartment where the transfer element operates with the valve element to prevent the valve element from opening when the transfer element is not engaging the first compartment, in effect regulating the transfer of matter to the second compartment. The transfer element further operating with the valve element to prevent articles, particulates, fluids, gases, odors, etc. from the second compartment from entering the first compartment when the valve element is open.

Also another object of the present invention is to provide a method for transferring an article into a container while regulating the transfer of matter to and from the container, the steps of the method including: closing a valve element; opening a first compartment; receiving an article in the first compartment; closing the first compartment by inserting the transfer element into it; opening the valve element thereby advancing the article into second compartment and progressing the transfer element up to the valve element; and closing the valve element for resetting the system.

These and other features and advantages of the present invention will become more readily appreciated as the same becomes better understood by reference to the following detailed description when considered in connection with the accompanying drawings, wherein some embodiments of the present invention are illustrated as an example and are not limited by the figures of the drawings.

DETAILED DESCRIPTION OF THE EMBODIMENTS

Figure 1:
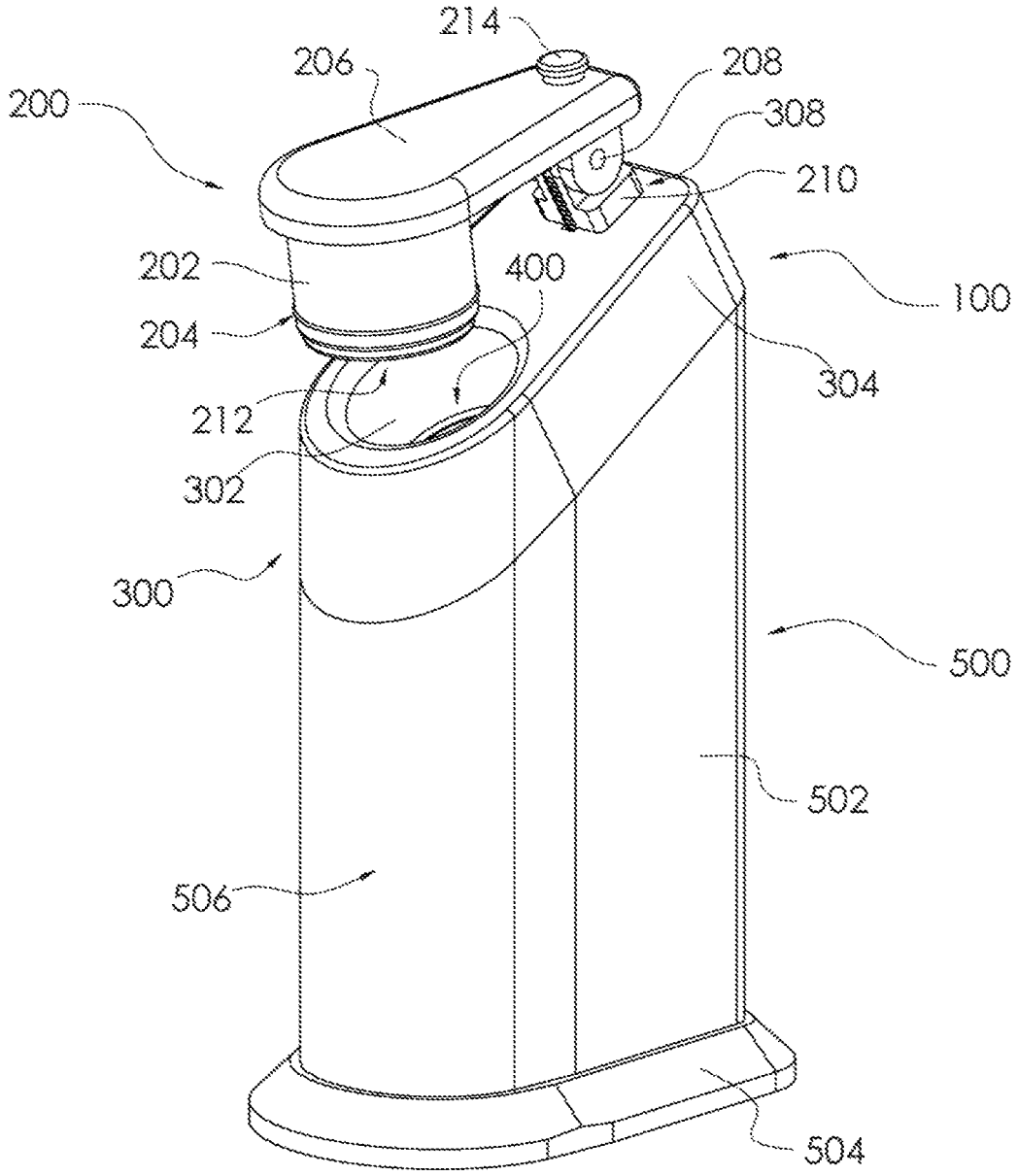
FIG. 1 illustrates a perspective view of an airlock apparatus mounted on top of a storage container in accordance with an embodiment of the present application.

Referring to FIGS. 1-5, wherein like numerals indicate like or corresponding parts throughout several views, an airlock apparatus 100 is shown mounted on top of the container housing 502 of a storage container 500 in accordance with an embodiment of the present disclosure. However, it will be appreciated that the invention is equally applicable when mounted to the front, side, bottom, or any other exterior or interior location of a container housing 502 or similar volume designated to, for example, receive/store at least one article 700. The container housing 502 may include provisions for attaching an optional film or liner 508 (not shown) within the storage compartment 506 for collecting deposited articles 700. The liner 508 may be made of a plastic, paper, or a biodegradable, a recyclable, or any other suitable material. The liner 508 may further be tubular with two open ends, with one end being sealed or readily sealable by any appropriate tying, sealing, or closing means. A support skirt 504 may also be provided for stabilizing the storage container 500 with the mounted airlock apparatus 100. Of course, the ornamental designs and specific arrangements of the various structures and elements may be used to provide different aesthetic qualities and/or structural properties without departing from the scope and spirit of this invention.

In one embodiment, the airlock apparatus 100 includes a transfer element assembly 200, a first compartment assembly 300, a valve assembly 400, and an energy transmission assembly 600. It is noted that more than one of each, or of all, of these assemblies may be used if desired.

The first compartment assembly 300 preferably includes a first compartment 302, located within a first compartment housing 304, to allow the receipt of a transfer element 202. The transfer element 202, which may resemble a piston in one non-limiting embodiment, advances an article 700 through the first compartment 302 to a second compartment 408, past the valve assembly 400. A guide channel 308, also located within the first compartment housing 304, hosts a translating extension arm 210 bridged to the transfer element 202 by a lid 206 at pivot 208. The extension arm 210 and guide channel 308 are preferably of a prismatic shape but may be of any geometry that prevents rotation of the extension arm 210. However, another embodiment may offer a design where the rotation of the extension arm 210 is preferred, in which case, an extension arm 210 an a guide channel 308 with a round geometry may be desirable. Further, another embodiment may include a telescoping transfer element to accommodate a first chamber of various depths, if desired.

Figure 2C:
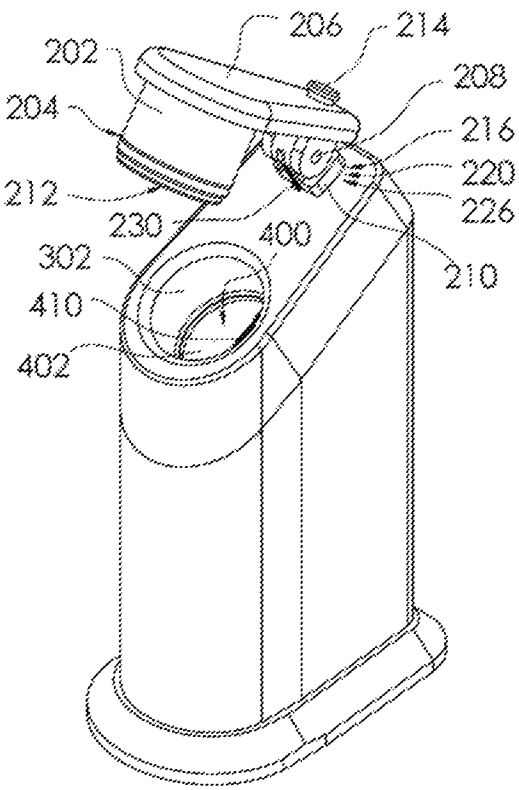
FIG. 2C illustrates the airlock apparatus of FIG. 1 with the transfer element assembly thereof in an open position.
Figure 2B:
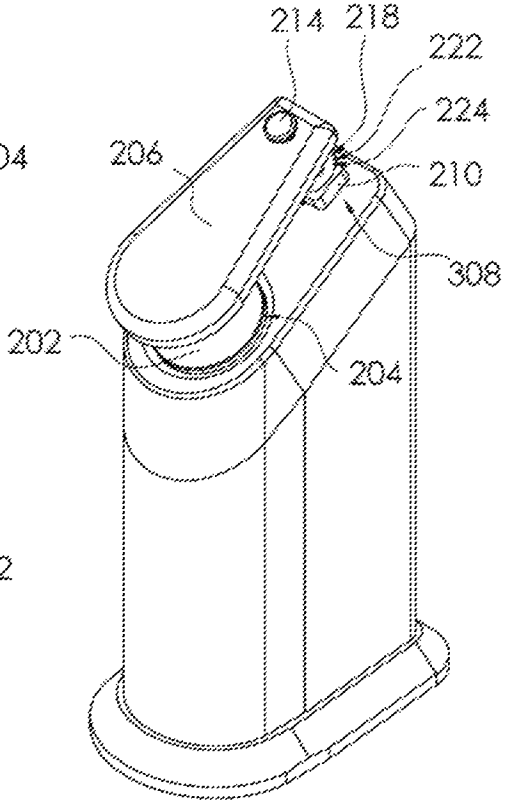
FIG. 2B illustrates an airlock apparatus of FIG. 1 with the transfer element assembly thereof in a semi-open position.
Figure 2A:
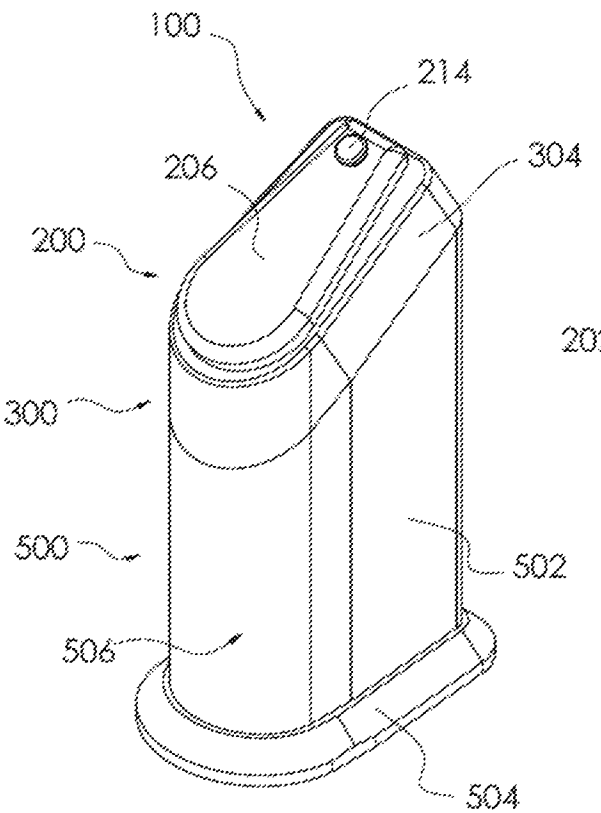
FIG. 2A illustrates an airlock apparatus in accordance with an embodiment of the present application illustrating the transfer element assembly thereof in a closed position.

Referring now to FIG. 2, the translational motion of the extension arm 210 within the guide channel 308 along with the rotational motion of the lid 206 about a pivot 208 permits the transfer element assembly 200 to be positioned in a "closed position" (see FIG. 2A), "semi-open position" (see FIG. 2B), and "open position" (see FIG. 2C) configuration. While in the closed position, the unit has a compact form factor while offering an added level of sealing for the contained material. The semi-open position is an intermediary stage between the closed and the open positions, with the open position offering unobstructed access to the first compartment 302.

Figure 3A:
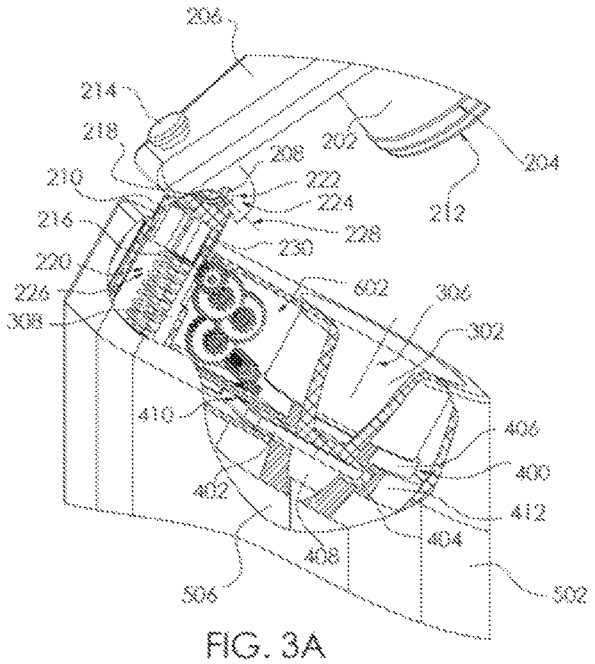
FIG. 3A is a detailed cutaway view of the airlock apparatus in accordance with an embodiment of the present application illustrating the transfer element assembly thereof in an open position with the valve gate of the airlock apparatus in a closed valve position.
Figure 3B:
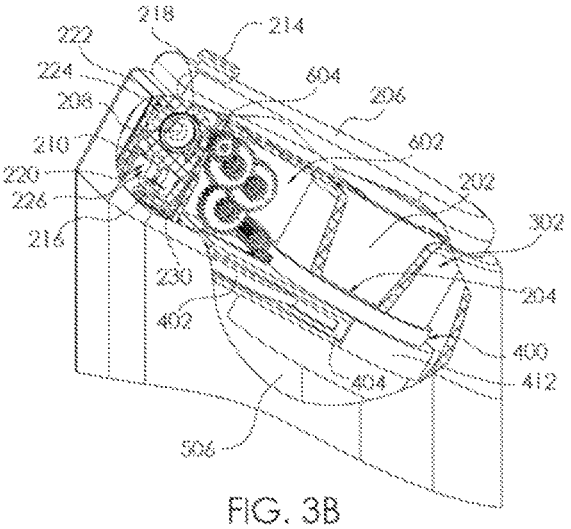
FIG. 3B is a detailed cutaway view of the airlock apparatus in accordance with an embodiment of the present application illustrating the transfer element assembly thereof in a closed position with the valve gate of the airlock apparatus beginning to move from an open valve position to a closed valve position.
Figure 3C:
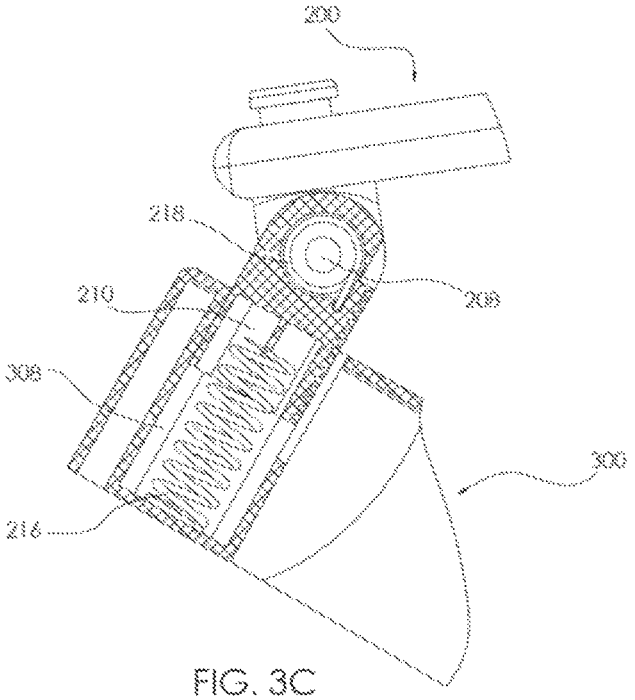
FIG. 3C is a detailed cutaway, sectional view of the airlock apparatus in accordance with an embodiment of the present application illustrating one example of applying biasing elements to the transfer element assembly.
Figure 6B:
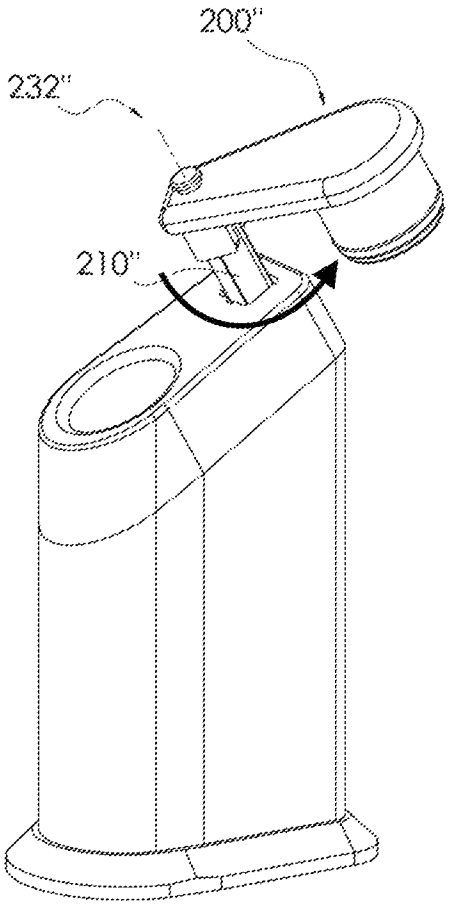
FIG. 6B illustrates an airlock apparatus in accordance with an embodiment of the present application illustrating an alternate open position where the transfer element assembly of the airlock apparatus rotates about an axis in-line with the extension arm of the airlock apparatus.
Figure 6A:
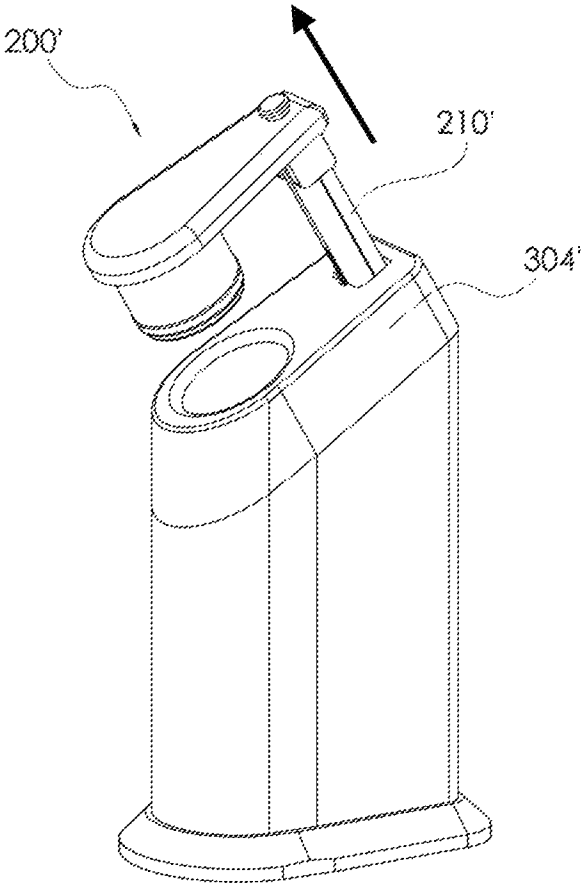
FIG. 6A illustrates an airlock apparatus in accordance with an embodiment of the present application illustrating an alternate open position where the transfer element assembly of the airlock apparatus extends further out of the first compartment housing of the airlock apparatus.

The transfer element assembly 200 may transition from the closed position to the semi-open position through purely linear motion along the first compartment longitudinal axis 306 (FIG. 3A). At this point, the transfer element 202 will have sufficient clearance to disengage from the first compartment 302. The transfer element assembly 200 may then be progressed from the semi-open position to the open position through purely rotational motion about an axis of rotation 228 of the pivot 208 (FIG. 3A) until access to the first compartment 302 is unhindered for inserting an article 700. In another embodiment, a transfer element assembly 200' may be progressed from the semi-open position to an open position through a purely linear motion by allowing an extension arm 210' to extend further out of a first compartment housing 304', such that a pivot 208 is not necessary (see FIG. 6A). In yet another embodiment, a transfer element assembly 200" may be progressed from a semi-open position to an open position through a rotational motion about an axis 232" colinear with the longitudinal axis of the extension arm 210", such that the pivot 208 is not necessary (see FIG. 6B). In general, other embodiments may include a transfer element assembly that progresses to an open position through a means other than those described without departing from the spirit and scope of this invention.

Figure 7A:
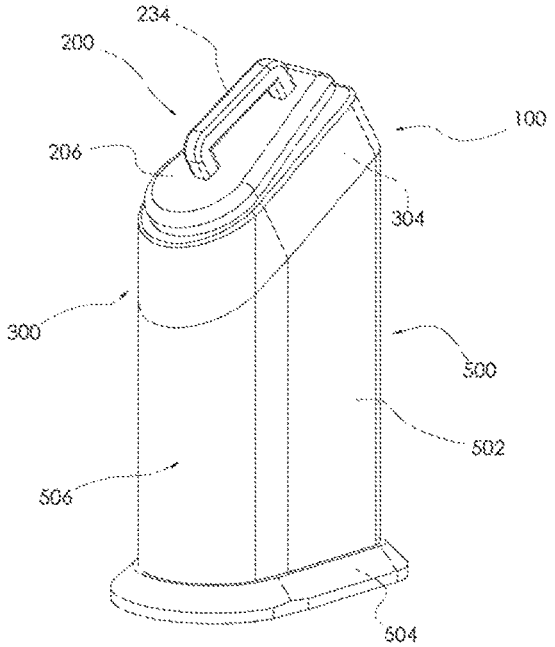
FIG. 7A illustrates an exemplary handle provided on the airlock apparatus of FIG. 1 as alternate means of operating the transfer element assembly of the airlock apparatus with the transfer element assembly in a closed position.
Figure 7B:
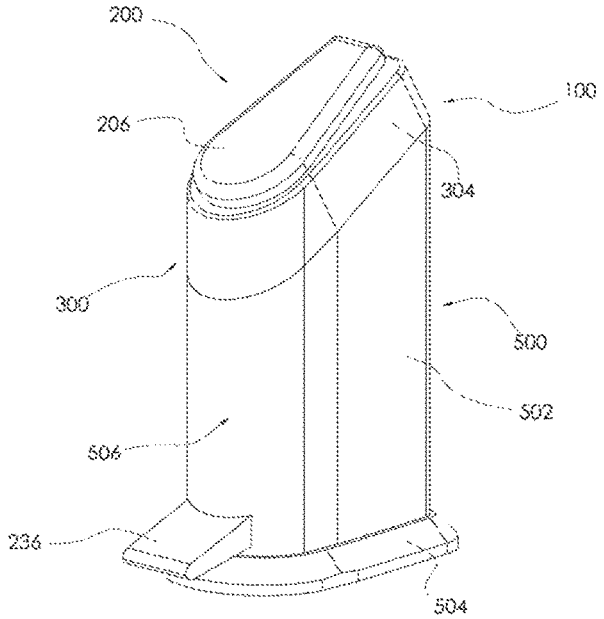
FIG. 7B illustrates an exemplary pedal provided on the container housing of the airlock apparatus of FIG. 1 as alternate means of operating the transfer element assembly of the airlock apparatus with the transfer element assembly in a closed position.
Figure 7C:
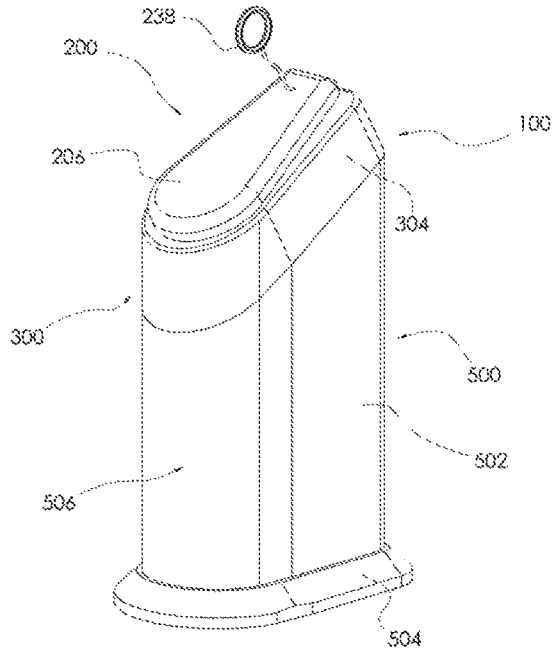
FIG. 7C illustrates an exemplary pull-cord provided on the airlock apparatus of FIG. 1 as alternate means of operating the transfer element assembly of the airlock apparatus with the transfer element assembly in a closed position.
Figure 7D:
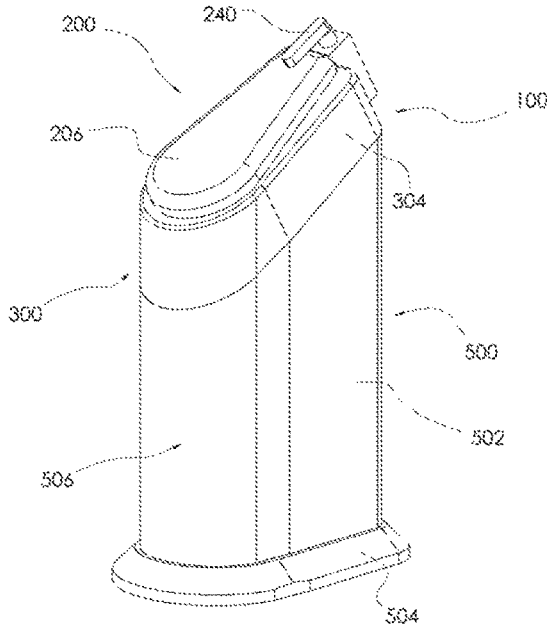
FIG. 7D illustrates an exemplary actuator provided on the airlock apparatus of FIG. 1 as alternate means of operating the transfer element assembly of the airlock apparatus with the transfer element assembly in a closed position.

In one embodiment, the aforementioned sequence may be executed automatically after activating a lid open button 214, for example, through the use of usual mechanical energy storage or exertion elements well-known in the art, generally shown at 216 and 218, which may include but are not limited to springs, elastic members, counterweights and pulleys, or actuators. Moreover, damping element may be employed to smoothen the motions, such damping elements may include but are not limited to dashpots or similar items well-known in the art for regulating velocity, generally shown at 220 and 222. In alternate embodiments, other suitable activation means for executing the aforementioned sequence, such as a handle 234 (see FIG. 7A), a pedal 236 (see FIG. 7B), a pull-cord 238 (see FIG. 7C), or an actuator 240 (see FIG. 7D) may be implemented instead of, or in addition to, the lid open button 214 without departing from the spirit and scope of this invention. In yet another embodiment, said handle 234, pedal 236, pull-cord 238, actuator 240, or the like may be used to directly operate the airlock apparatus 100, by, for example, manually moving the transfer element assembly 200 from the closed position to the open position and/or from the open position to the closed position, without departing from the spirit and scope of this invention.

Figure 8B:
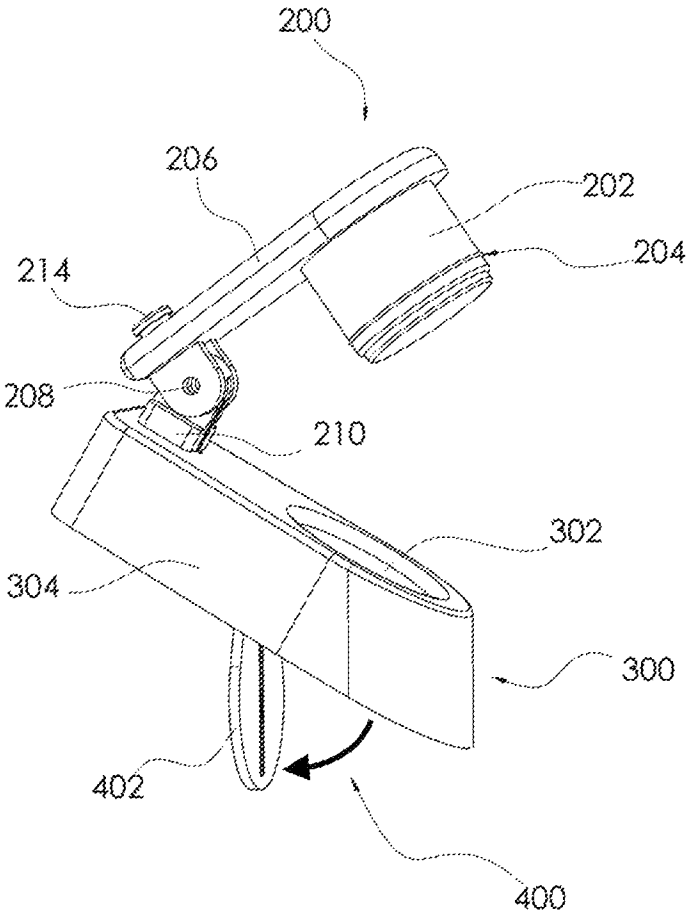
FIG. 8B illustrates a perspective view of an airlock apparatus in accordance with an embodiment of the present application illustrating a swinging valve element swinging open along the sagittal plane of the airlock apparatus.
Figure 8A:
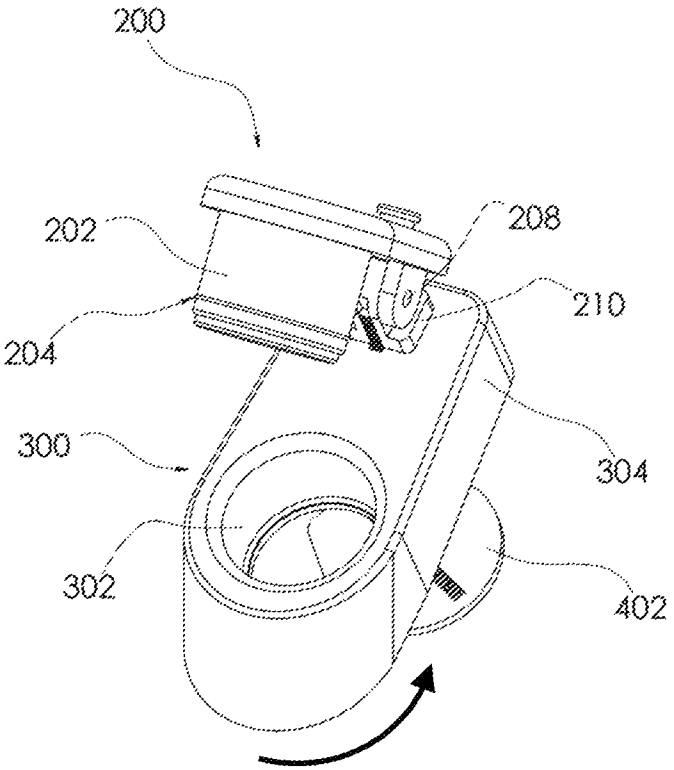
FIG. 8A illustrates a perspective view of an airlock apparatus in accordance with an embodiment of the present application illustrating a swinging valve element swinging open along the lateral plane of the airlock apparatus.
Figure 9C:
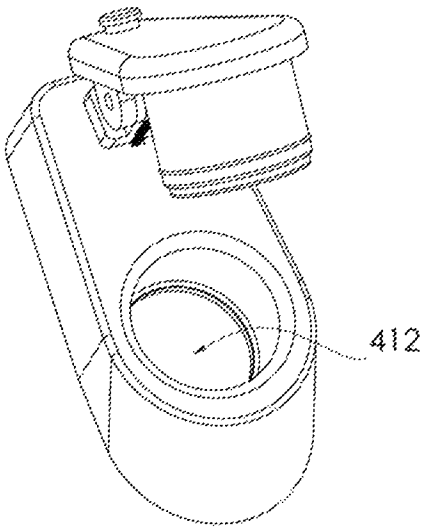
FIG. 9C illustrates the iris gate valve of FIG. 9A in an open valve position.
Figure 9B:
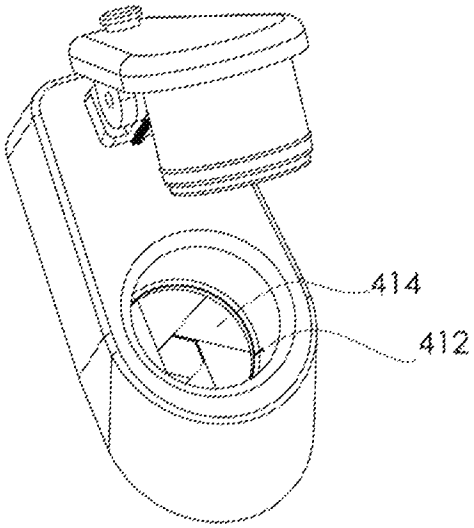
FIG. 9B illustrates the iris gate valve of FIG. 9A in a semi-open valve position.
Figure 9A:
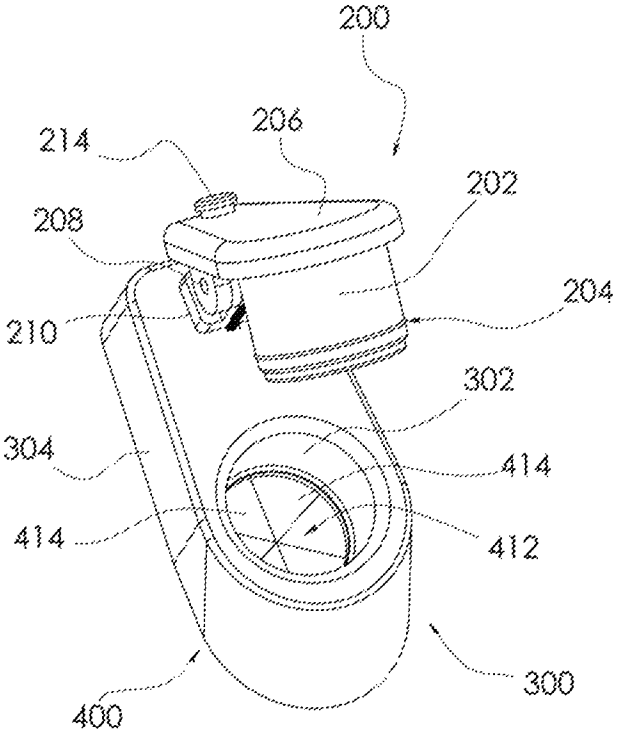
FIG. 9A illustrates a perspective view of an airlock apparatus in accordance with an embodiment of the present application illustrating an iris gate valve element in a closed valve position.

The distal side of the first compartment 302, relative to the entry point of the transfer element 202, leads to the valve assembly 400 which includes a valve gate 402, a gate seal 404, a valve housing 406, and a second compartment 408. In one non-limiting embodiment, the valve gate 402 may be a sliding gate that translates within a track in the valve housing 406 from a "closed valve position" (see FIG. 3A) to an "open valve position" (see FIG. 3B). In the closed valve position, the valve gate 402 is seated within the gate seal 404 and hermetically seals off the second compartment 408 from the first compartment 302. Translating the valve gate 402 into the open valve position while translating the transfer element 202 within the first compartment 302 to a "sealing position" (where the transfer element 202 prevents matter from the second compartment from entering the first compartment) allows the article 700 and any encompassing matter of the first compartment 302 (e.g. particulates, fluids, gasses, odors) to be advanced into the second compartment 408 by the transfer element 202. The valve gate 402 may then be actuated into the valve closed position such that the contents of the second compartment 408 and, in turn, the storage compartment 506 will be sealed shut as the transfer element 202 withdraws from the first compartment 302. In another embodiment, the valve gate 402 may be a swinging gate that swings along the lateral plane (see FIG. 8A), a sagittal plane (see FIG. 8B), or any other suitable plane to achieve motion between a closed valve position and an open valve position. In yet another embodiment, the valve gate may be an iris gate 412 consisting of a plurality of doors 414, where at least one of said door 414 moves between a closed valve position (see FIG. 9A), a semi-open valve position (see FIG. 9B), and an open valve position (see FIG. 9C).

A transfer element seal 204 (which may be in the form of a piston ring, in one embodiment) may be affixed to the outer surface of the transfer element 202 for the purpose of creating an impervious seal between the transfer element 202 and first compartment 302. The impervious seal may also be achieved through any means known in the art, including but not limited to grease, sealing compound, or close-fitting components which minimize leak paths. In another embodiment, the seal may not be completely impervious such that the seal may be unnecessary.

A check valve vent 212 may be provided within the transfer element 202 to allow the inflow of gases or fluids to the volume between the transfer element seal 204 and valve gate 402 to overcome the negative pressure generated by the transfer element 202 as it withdraws from the first compartment 302. In another embodiment, a floating O-ring, gasket, piston seal, or any other means of allowing venting during the withdraw step of the transfer element 202, may be provided on the transfer element 202 instead of, or in addition to, the check valve vent 212.

Figure 10B:
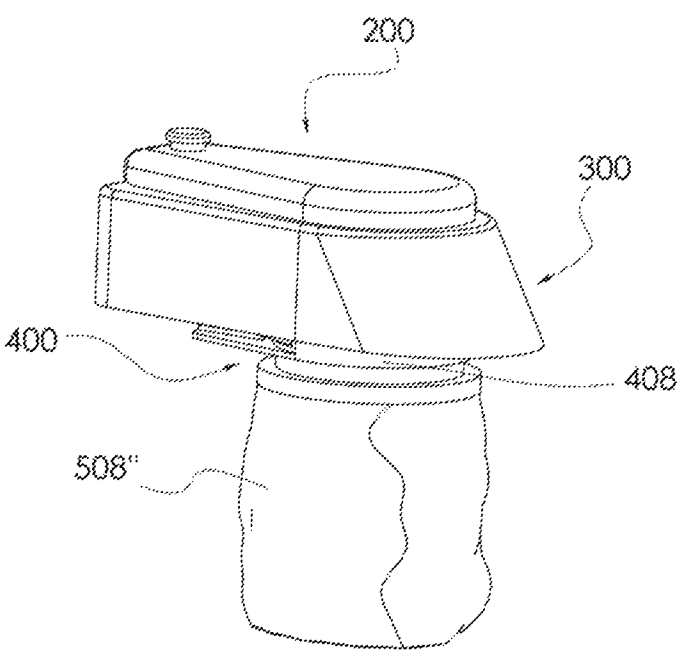
FIG. 10B illustrates the liner of FIG. 10A in an inflated state.
Figure 10A:
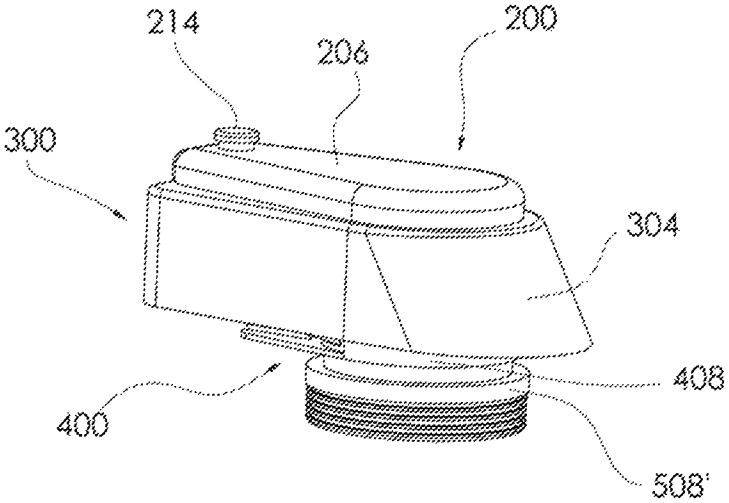
FIG. 10A illustrates a perspective view of an airlock apparatus in accordance with an embodiment of the present application illustrating a liner attached to the second compartment with the liner in a collapsed state.
Figure 11:
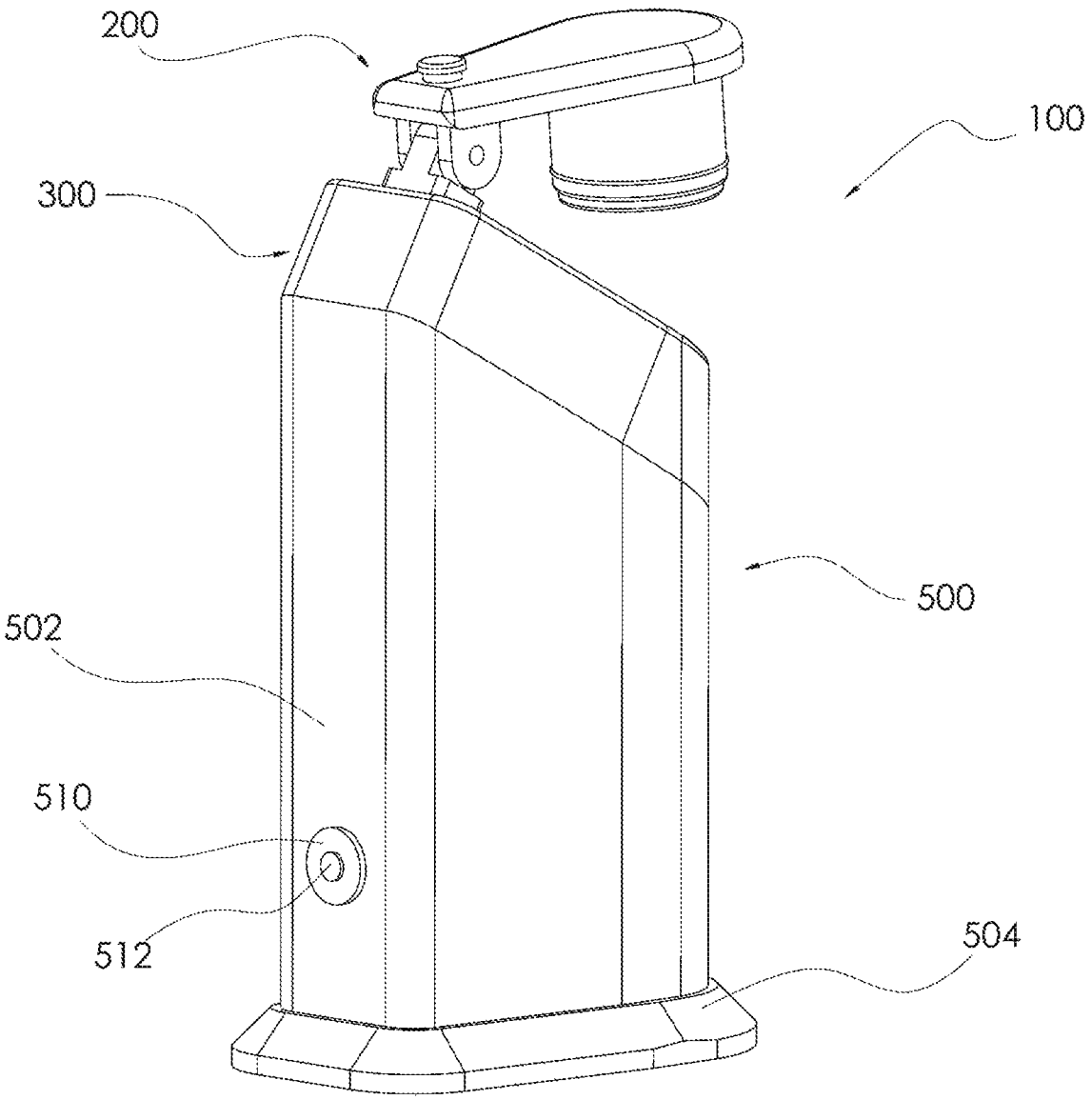
FIG. 11 illustrates an exemplary vent and filter provided on the container housing of the airlock apparatus of FIG. 1 permitting the release of accumulated pressure inside the container housing.

In one embodiment, the advancement of the article 700 and accompanying gasses and particulates therewith by the transfer element 202 may pressurize the second compartment 408 and, in turn, the storage compartment 506. Therefore, the liner 508 may be installed in a collapsed configuration 508', proximal to and in communication with the second compartment 408 (see FIG. 10A), to be inflated 508" through the act of an article 700 being loaded into it (see FIG. 10B), providing for a convenient way to load the liner 508 into the storage container 500. In another embodiment, a check valve vent 510 (see FIG. 11) may otherwise or additionally be included within the container housing 502, along with an optional filter 512, to relieve the accumulated pressure. Alternate embodiments may include other means of addressing pressurization of the second compartment 408 and the storage compartment 506 without affecting the spirit of this invention, including but not limited to the use of a vacuum pump or inflatable bladder or any other suitable component or assembly.

Figure 4A:
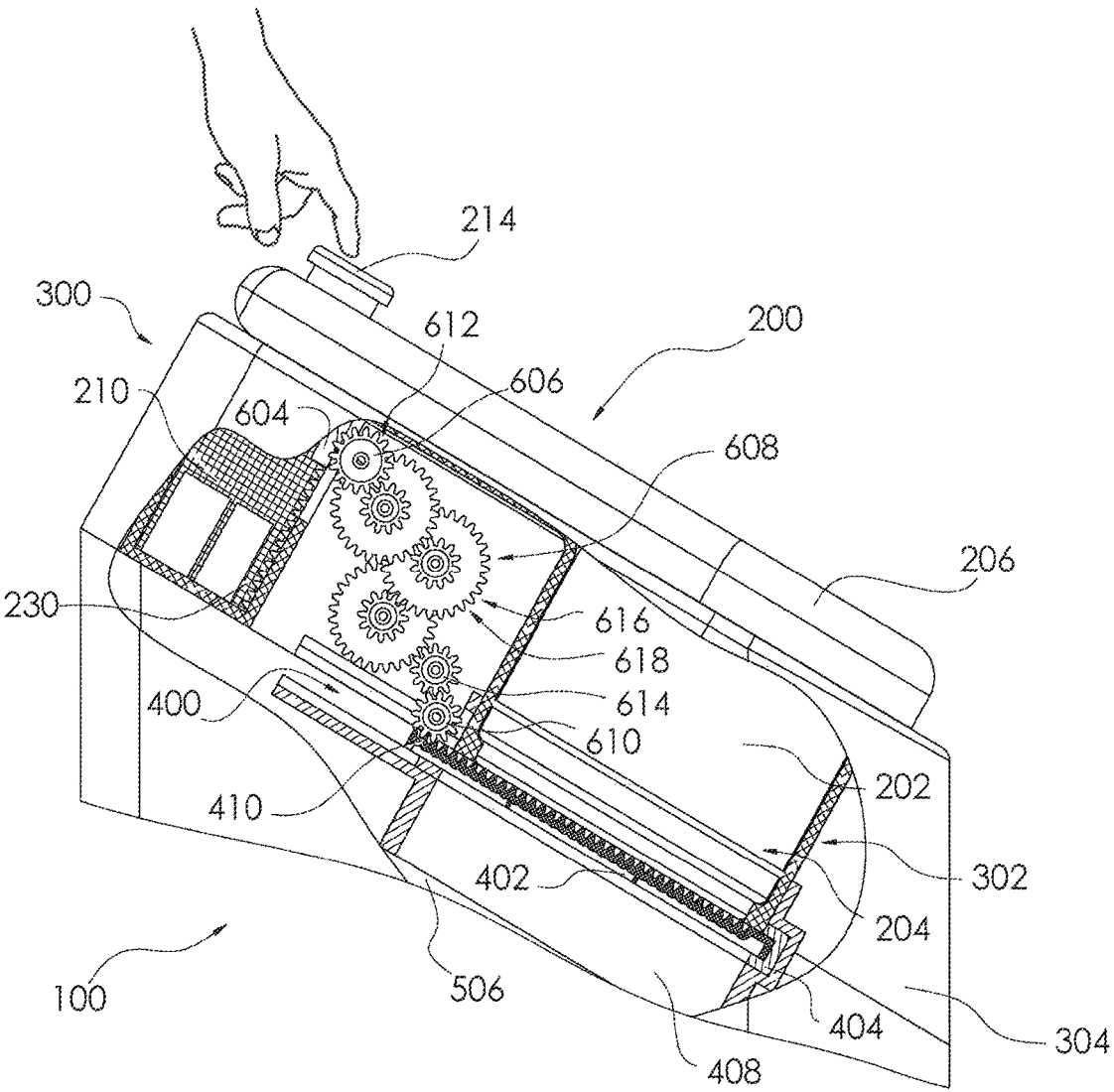
FIGS. 4A-4E are detailed cutaway, sectional views of the airlock apparatus in accordance with an embodiment of the present application illustrating an operational sequence of the airlock apparatus.
Figure 4B:
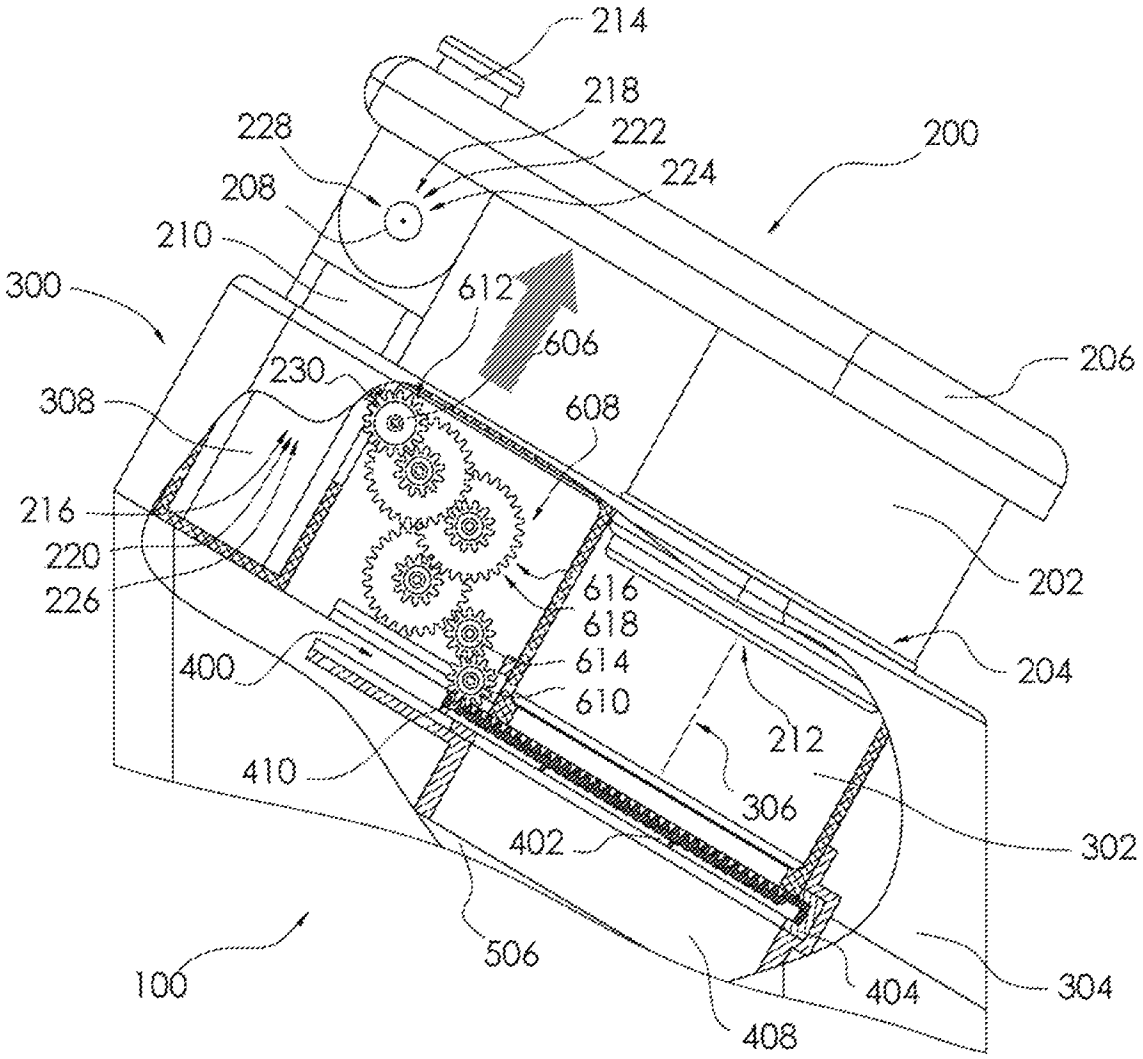
Figure 4C:
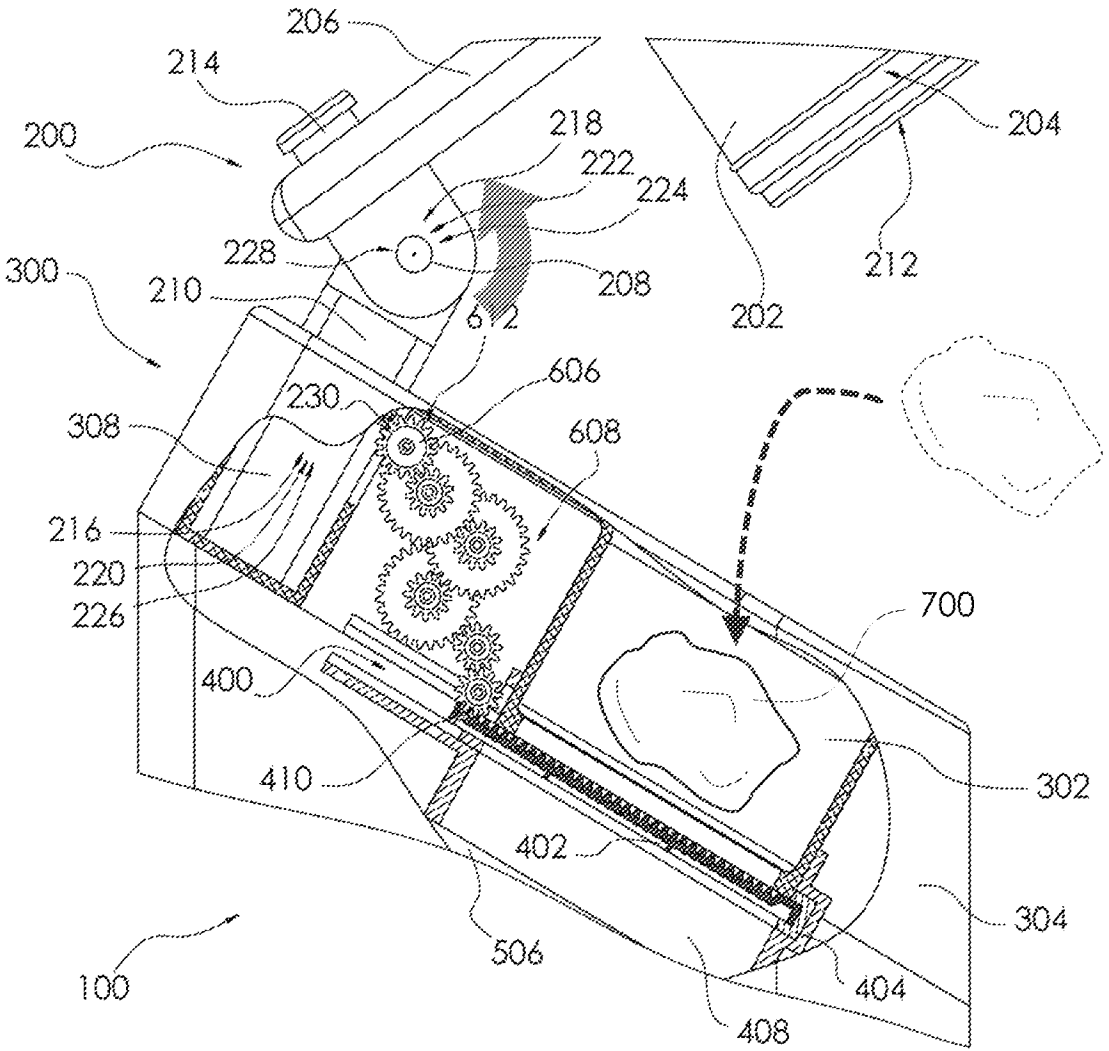
Figure 4D:
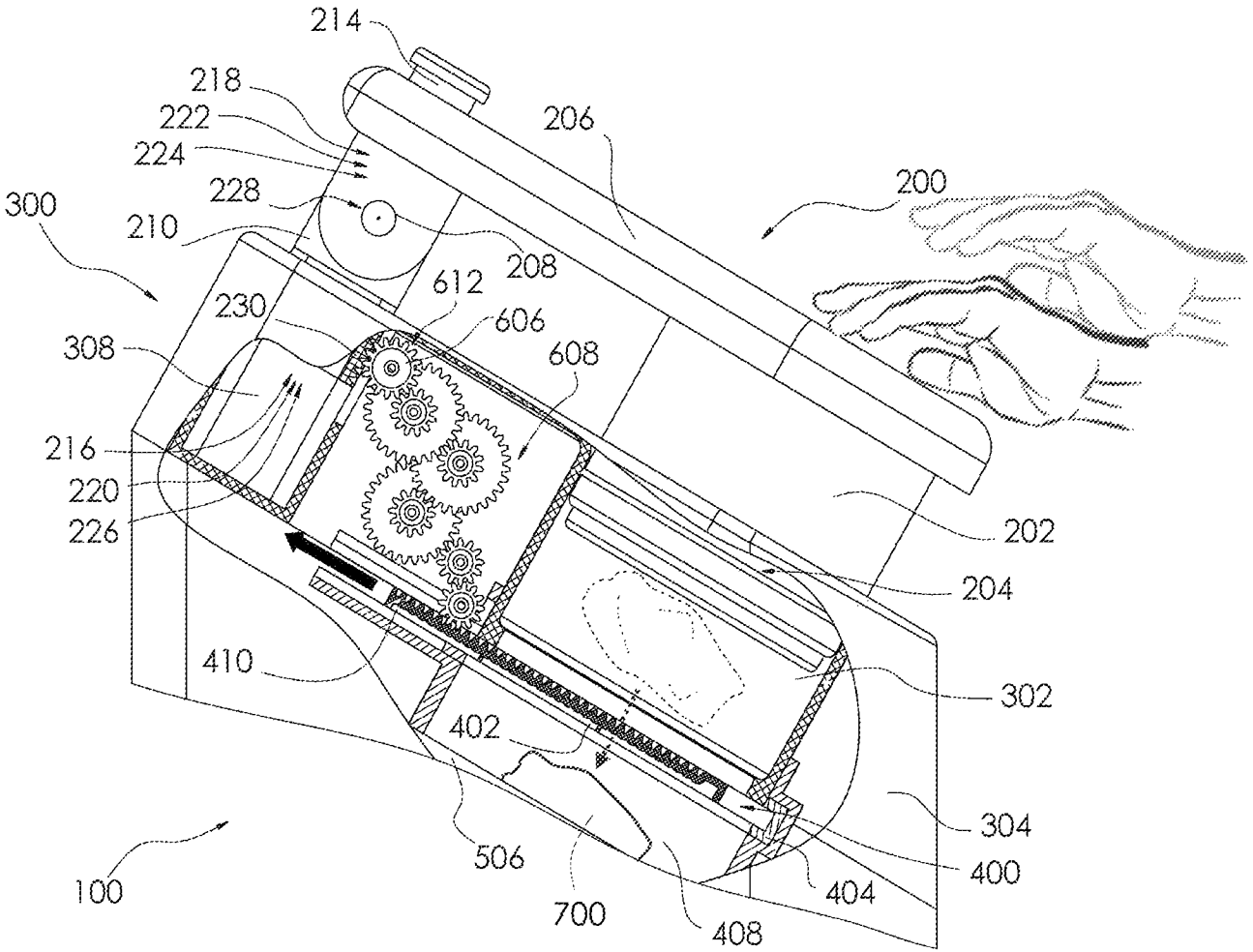
Figure 4E:
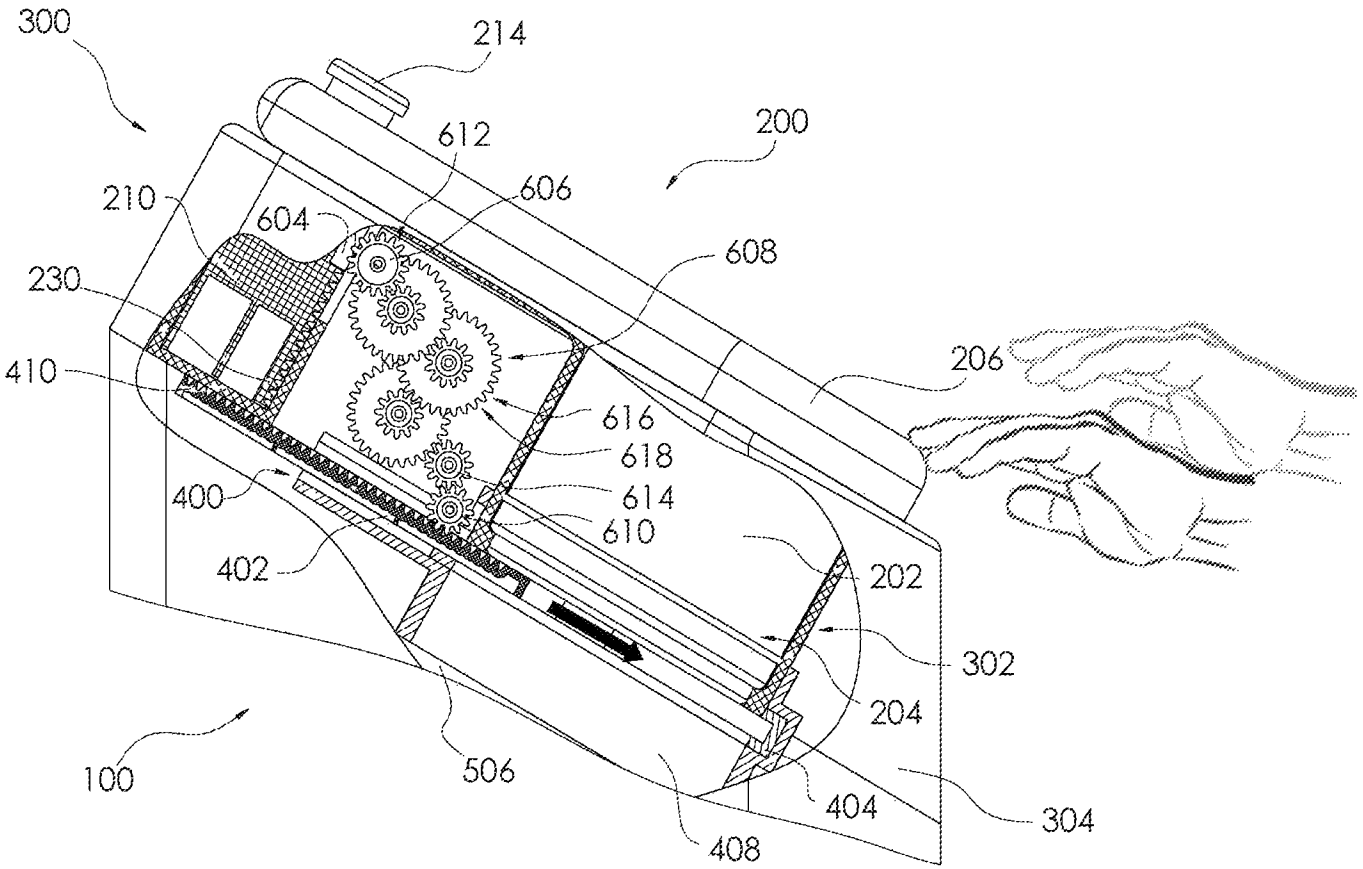
Figure 5:
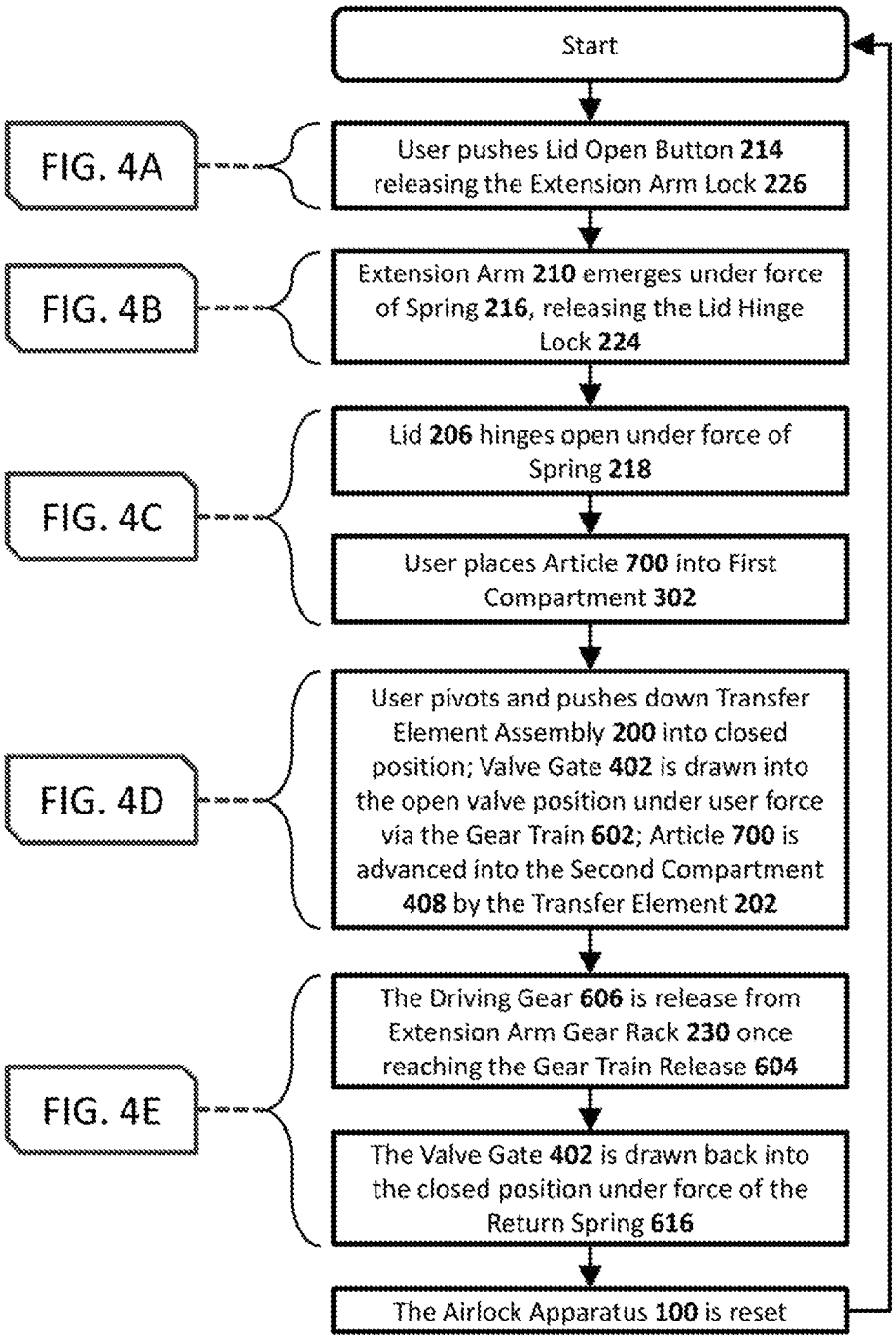
FIG. 5 illustrates a flowchart of the exemplary operational sequence of FIG. 4.

The operation of the airlock apparatus 100 in accordance with an embodiment of the present application is described in more detail with reference to FIG. 4 and is summarized in the exemplary flowchart of FIG. 5. As a first step, the lid open button 214 is depressed (FIG. 4A) to release the transfer element assembly 200 from its closed position. This begins the automatic opening sequence (see FIGS. 4B and 4C). An extension arm lock 226 may be provided to keep the transfer element assembly 200 in the closed position until the lid open button 214 is pressed. Similarly, a lid hinge lock 224 may be employed to keep the lid 206 from swinging open until the transfer element assembly 200 is in the semi-open position. Any known lock mechanism or assembly in the art may be implemented to achieve this effect, including but not limited to a ratchet and pawl. Once the transfer element assembly 200 is in the open position, an article 700 may be inserted into the first compartment 302 (FIG. 4C). The transfer element assembly 200 may then be manually brought into the closed position. This may be achieved by first maneuvering the transfer element assembly 200 into the semi-open position through rotation about the pivot axis of rotation 228 and then into the closed position by guiding the transfer element assembly 200 along the first compartment longitudinal axis 306 (FIGS. 4D and 4E). In one embodiment, to improve the operational experience during the manual closing operation, the lid hinge lock 224 and extension arm lock 226 may be designed to be incremental, such that the components being manually closed do not tend to move back to their open positions if not closed all the way. In yet another embodiment, an opening sequence may be provided such that the arm lock 226 and lid hinge lock 224 may be unnecessary.

In one embodiment, the energy transmission assembly 600 is utilized to achieve the aforementioned operation of the transfer element 202 with the valve gate 402. More specifically, in an embodiment, a gear rack 230 is built directly into the extension arm 210, which engages the energy transmission assembly 600. The energy transmission assembly 600 includes a gear train 602 that includes of a driving gear 606 engaged with the extension arm gear rack 230. The driving gear 606 is coupled to a ratchet 612. The ratchet 612 is active only on the manually engaged stroke of the extension arm 210 at which point it drives a series of compound gears 608. The series of compound gears 608 engage an idler 614 which, in turn, engages a driven gear 610. The driven gear 610 couples to a gear rack 410 built into the valve gate 402. The effective gear ratio of the series of compound gears 608 is that which allows for the valve gate 402 to translate from the closed valve position the open valve position as the transfer element assembly 200 travels from the semi-open to the closed position (FIGS. 4D and 4E). As the transfer element assembly 200 reaches the closed position, and by extension, the transfer element 202 reaches the sealing position, the driving gear 606 arrives at the gear train release 604 (FIG. 4E), which, in one embodiment, may be a recess in the extension arm gear rack 230. The gear train release 604 decouples the driving gear 606 from the extension arm gear rack 230 allowing the valve gate 402 to return to the closed valve position (FIG. 4E), effectively resetting the mechanism for the next cycle. This may be accomplished through the use of an element biasing the valve gate 402 toward the closed valve position, for example, a return spring 616. Further, a rotational damper 618 or other usual dampening structure (e.g. cushioning bumper) may be utilized to soften the return motion of the valve gate 402 to the closed valve position.

Figure 12:
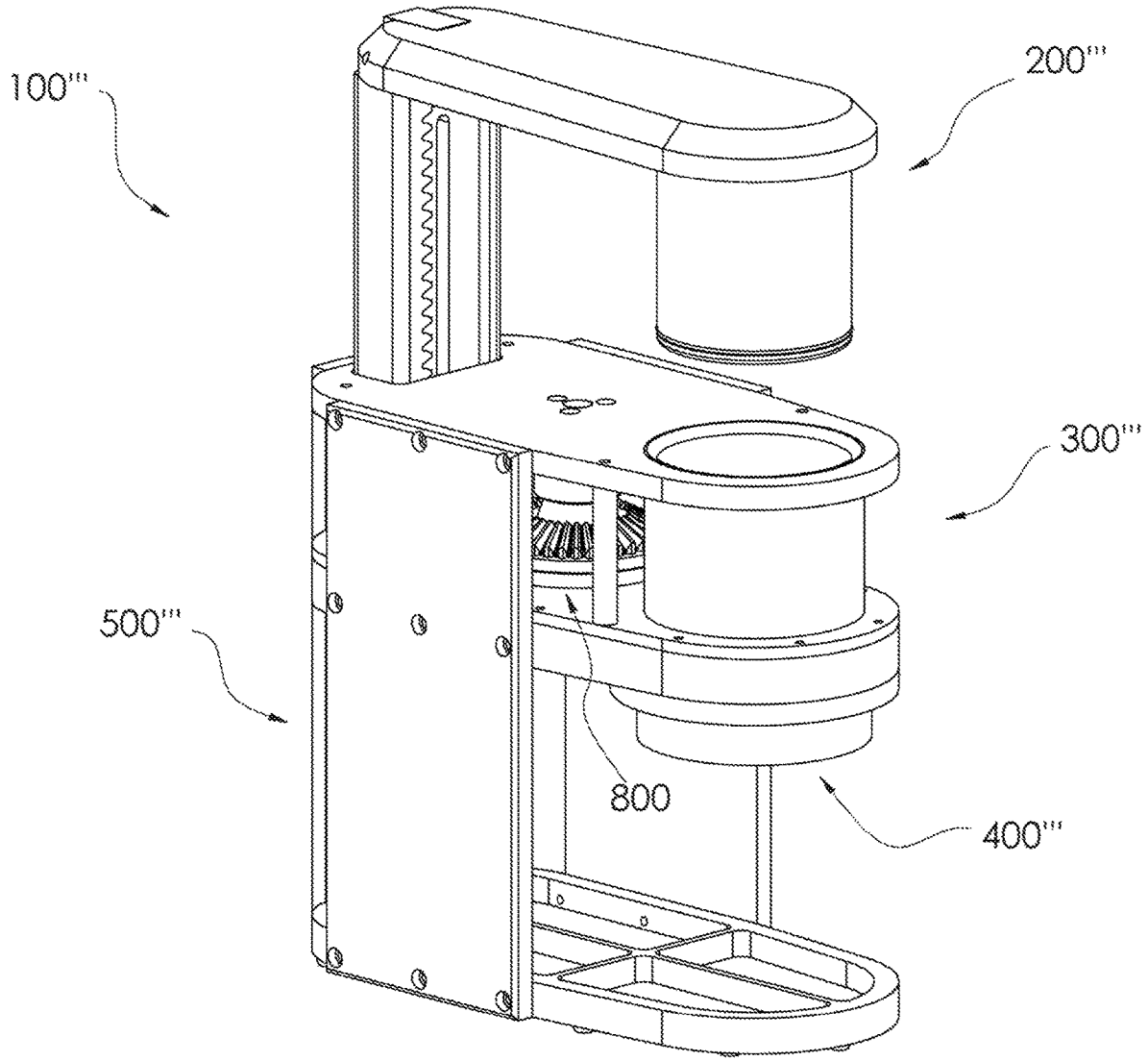
FIG. 12 illustrates a perspective view of an airlock apparatus mounted on top of a storage container in accordance with an embodiment of the present application illustrating an alternate energy transmission assembly thereof.

FIG. 12 illustrates an alternative embodiment of an airlock apparatus 100''' that is mounted on top of a storage container 500''' and includes a transfer element assembly 200''' including a transfer element 202''', a lid 206''', and an extension arm 210''', a first compartment assembly 300''' including a first compartment 302''', a valve assembly 400''' including a valve gate 402''', a valve housing 406''', and a second compartment 408''', and an energy transmission assembly 800.

Figure 13B:
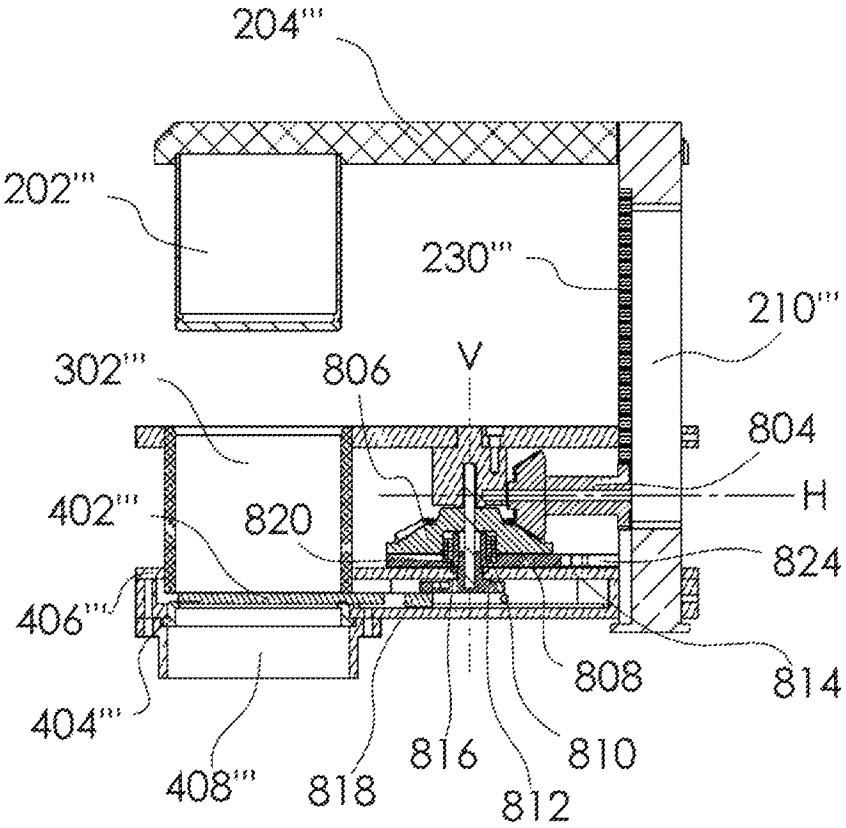
FIG. 13B is a detailed cross-sectional view of the airlock apparatus of FIG. 12 along the sagittal plane.
Figure 13A:
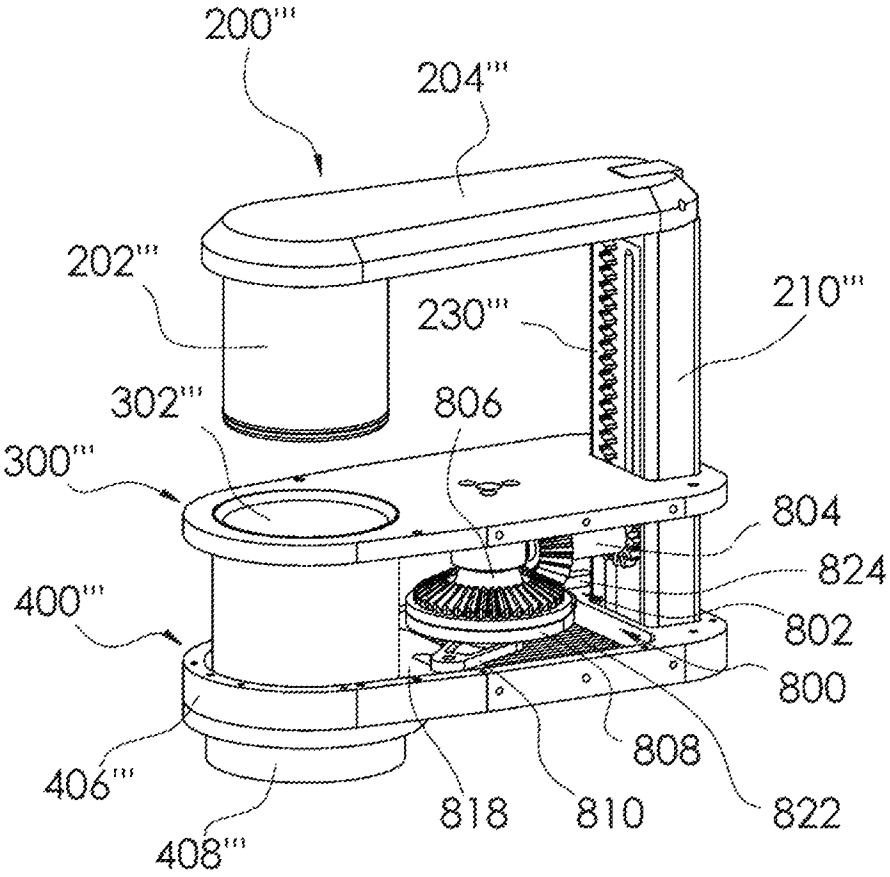
FIG. 13A illustrates a detailed view of the airlock apparatus of FIG. 12.

Referring now to FIG. 13, a gear rack 230''' is built directly into the extension arm 210''', which engages the energy transmission assembly 800. The energy transmission assembly 800 includes a gear train 802 that includes of a driving gear 804 engaged with the extension arm gear rack 230''' and rotating about an axis H. The driving gear 804 is meshed with a bevel gear 806 at 90 degrees, the bevel gear 806 rotating about an axis V. Further, the bevel gear 806 is coupled to a cam wheel 808 through a torsion spring 810 with the torsion spring 810 positioned with its rotational axis colinear with the axis V and disposed between the bevel gear 806 and the cam wheel 808. More specifically, one tine of the torsion spring 810 is anchored to the bevel gear 806 and the other tine of the torsion spring 810 is anchored to the cam wheel 808. The cam wheel 808 couples to a cam arm 812 through a cam arm drive feature 820 passing through an opening in a valve housing wall 814. A cam arm seal 816 is positioned within the opening of the valve housing wall 814 with the cam arm drive feature 820 passing through the cam arm seal 816. In this embodiment, the cam arm 812 drives a valve gate 818 through a scotch-yoke configuration. More specifically, rotation of the cam arm about the axis V linearly translates the valve gate 812 between and open valve position and a closed valve position with the valve gate 812 sliding along the valve gate track 822 located within the valve housing 406'''.

The airlock apparatus 100''' may be operated by moving the transfer element assembly 200''' into an open position where the first compartment 302''' is able to receive an article 700. Moving the transfer element assembly 200''' into an open position may be achieved by translating the extension arm 210''' out of the first compartment assembly 300''' manually or automatically through the use of a biasing element, actuator, any suitable actuation component, or a combination of said components. The translation of the transfer element assembly 200''' rotates the driving gear 804 with the extension arm gear rack 230''' which, in turn, rotates the bevel gear 806. A lock 824 holds the cam wheel 808 stationary during rotation of the bevel gear 806 allowing the torsion spring 810 to wind. More specifically, one tine of the torsion spring 810 is held in place by the cam wheel 808, which itself is being held in place by the lock 824, while the other tine of the torsion spring 810 is rotated around the axis V by the rotating bevel gear 806. An article 700 may now be loaded into the first compartment 302''' and the transfer element assembly 200''' moved such that the transfer element 202''' engages the first compartment 302. The lock 824 is released allowing the cam wheel 808 to rotate in the direction that un-winds the torsion spring 810 translating the valve gate 818 into the valve open position allowing access to the second compartment 408'''. The release of the lock 824 may be achieved by positioning the lock 824 proximal to the extension arm 210''' such that the extension arm 210''' may trigger the release of lock 824 though a protruding, recessed, or other suitable feature or component well known in the art at a desirable moment during the motion of the transfer element assembly 200'''. Progressing the transfer element 202''' further into the first compartment 302''' forces the article and particulates, fluid, gasses, odors, and matter into the second compartment 408'''. The downward motion of the transfer element 202''', and in effect the transfer element assembly 200''', moves the valve gate 818 back into the closed valve position through the energy transmission assembly 800. A gate seal 404''' may be provided within the valve housing 406''' to engage with the valve gate 818 to provide a hermetic seal, if desired. While this arrangement illustrates one example of how the transfer element 202''' to operate with the valve gate 818''' (a valve element) in accordance with an embodiment of the present invention, other arrangements may be implemented to achieve comparable results without departing from the spirit and scope of the present invention.

Figure 14:
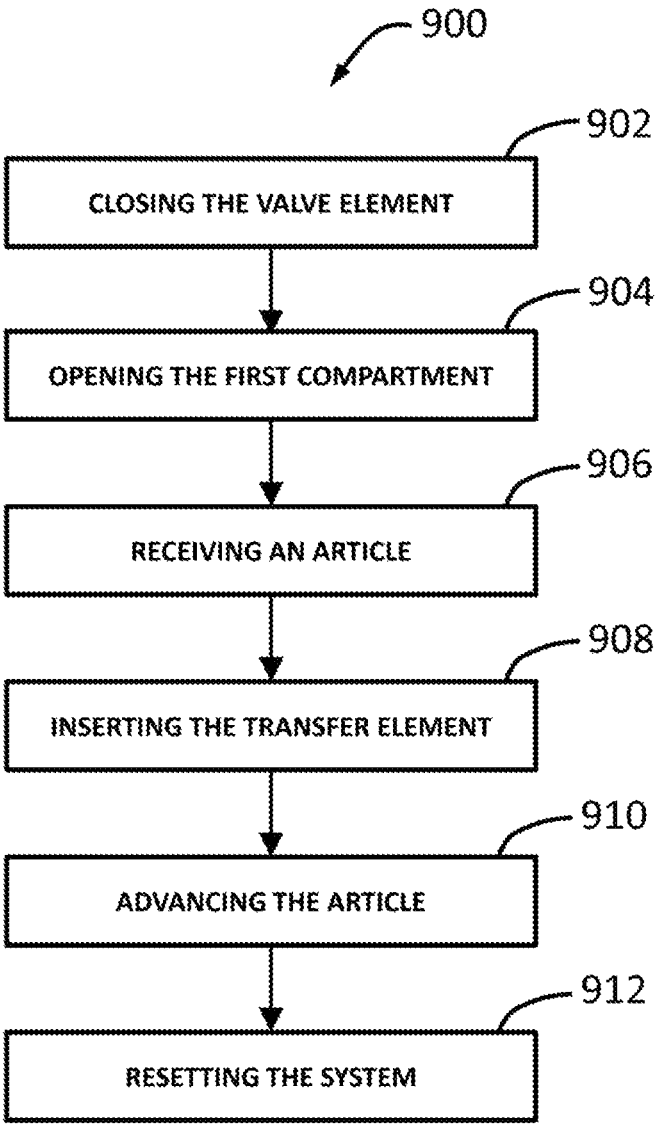
FIG. 14 illustrates a flow diagram for a method for transferring an article into a container while regulating the transfer of matter to and from the container in accordance with an embodiment of the present application.

The present invention also includes a method 900 (FIG. 14) for transferring an article into a container with a first compartment at one end, the first compartment having a first open end and a second open end opposite the first open end, a transfer element moving into and out of the first open end of the first compartment, a valve element with a first open end and a second open end opposite the first open end positioned with the first open end of the valve element in communication with the second open end of the first compartment, the valve element being movable between a closed position in which the first compartment is not in communication with a second compartment and an open position in which the first compartment is in communication with the second compartment, the second compartment having an open end and positioned with the open end of the second compartment in communication with the second open end of the valve element, the steps including: closing the valve element when the container is in a non-use position 902; opening the first open end of the first compartment as a result of the transfer element being withdrawn out of the first compartment 904; receiving an article in the first open end of the first compartment 906; inserting the transfer element into the first open end of the first compartment 908; advancing the article into the open end of the second compartment as a result of opening the valve element and progressing the transfer element up to the first open end of the valve element 910; and resetting the system as a result of closing the valve element 912.

Although the present invention and its advantages have been illustrated and described in detail herein with reference to several embodiments and examples thereof, it will be readily apparent to those of ordinary skill in the art that other embodiments and examples may perform similar functions, achieve like results, and have other applications. All such equivalent embodiments and examples are within the spirit and scope of the present invention, are contemplated thereby, and are intended to be covered by the following claims.

What is claimed is:

1. A device comprising:

a first compartment having a first open end and a second open end;

a second compartment having a first open end and a second open end;

a valve element having a first open end in communication with the first compartment, and a second open end in communication with the second compartment, the valve element being movable between a closed position in which the first compartment is not in communication with the second compartment, and an open position in which the first compartment is in communication with the second compartment; and a transfer element operable with the valve element for advancing at least one article or matter from the first compartment to the second compartment, wherein the transfer element is operable with the valve element such that the valve element is prevented from opening when the transfer element is not in the first compartment.

2. A device in accordance with claim 1, wherein the transfer element is operable with the valve element to prevent articles or particulates, fluids, gases, odors, or matter from the second compartment from entering the first compartment when the valve element is not in the closed position.

3. A device in accordance with claim 1, wherein the first open end of the first compartment is configured to receive said at least one article or matter.

4. A device in accordance with claim 1, wherein the closed position of the valve element creates a seal between the first compartment and the second compartment.

5. A device in accordance with claim 4, wherein the seal restricts the passage of gasses, matter, or odors from the second compartment to the first compartment.

6. A device in accordance with claim 4, wherein the seal is hermetic.

7. A device in accordance with claim 1, wherein the transfer element further comprises a vent configured to facilitate the inflow of gases or fluids to the first compartment during actuation of the transfer element away from the first compartment.

8. A device in accordance with claim 1, wherein the transfer element seals the first open end of the first compartment when the transfer element is within the first compartment.

9. A device in accordance with claim 1, wherein the valve element is a sliding gate comprised of at least one slidable door.

10. A device in accordance with claim 1, wherein the valve element is a swinging gate comprised of at least one swingable or hinged door.

11. A device in accordance with claim 1, wherein the valve element is an iris gate comprised of a plurality of doors.

12. A device in accordance with claim 1, wherein the transfer element is configured to advance particulates, fluids, gasses, or odors encompassed by the first compartment into the second compartment.

13. A device in accordance with claim 1, wherein the transfer element is operable with the valve element through an energy transmission means.

14. A device in accordance with claim 1, wherein the transfer element is operable with the valve element through a combination of gears, wheels, racks, springs, linkages, cables, and/or actuators.

15. A device in accordance with claim 1, wherein the second opening of the second compartment connects to a third compartment.

16. A device in accordance with claim 15, wherein the third compartment has an open end in communication with the second end of the second compartment and a closed end.

17. A device in accordance with claim 15, wherein the third compartment has an open end in communication with the second end of the second compartment and an open end.

18. A device in accordance with claim 17, wherein the open end of the third compartment is in communication with a pressure release element.

19. A device in accordance with claim 18, wherein the pressure release element is in communication with a filtration element such that the filtration element retards the passage of harmful or olfactory-offensive gasses or particulates while allowing other gases to pass through said filtration element.

20. A device comprising:

a first compartment having a first open end and a second open end;

a second compartment having a first open end and a second open end;

a valve element having a first open end in communication with the first compartment, and a second open end in communication with the second compartment, the valve element being movable between a closed position in which the first compartment is not in communication with the second compartment, and an open position in which the first compartment is in communication with the second compartment; and a transfer element operable with the valve element for advancing at least one article or matter from the first compartment to the second compartment, wherein the transfer element further comprises a vent configured to facilitate the inflow of gases or fluids to the first compartment during actuation of the transfer element away from the first compartment.

21. A device comprising:

a first compartment having a first open end and a second open end;

a second compartment having a first open end and a second open end;

a valve element having a first open end in communication with the first compartment, and a second open end in communication with the second compartment, the valve element being movable between a closed position in which the first compartment is not in communication with the second compartment, and an open position in which the first compartment is in communication with the second compartment;

a transfer element operable with the valve element for advancing at least one article or matter from the first compartment to the second compartment; and the second open end of the second compartment connects to a third compartment, wherein the third compartment has an open end in communication with the second end of the second compartment and an open end, wherein the open end of the third compartment is in communication with a pressure release element.

* * * * *